United States Patent [19]

Simpson

[11] 4,272,662

[45] Jun. 9, 1981

[54] TOGGLE SWITCH WITH SHAPED WIRE SPRING CONTACT

[75] Inventor: Kenneth Simpson, Lynnfield, Mass.

[73] Assignee: C & K Components, Inc., Newton, Mass.

[21] Appl. No.: 41,057

[22] Filed: May 21, 1979

[51] Int. Cl.[3] ..... H01H 13/28

[52] U.S. Cl. ..... 200/275; 200/153 H; 200/67 C; 200/153 K

[58] Field of Search ..... 200/275, 67 G, 67 C, 200/68, 153 G, 153 H, 153 K, 6 B, 243

[56] References Cited

U.S. PATENT DOCUMENTS

| | | | |
|---|---|---|---|
| 3,213,227 | 10/1965 | Heath | 200/67 C |
| 3,562,462 | 2/1971 | Long | 200/153 K |
| 3,670,121 | 6/1972 | Howe | 200/67 G |
| 3,742,171 | 6/1973 | Howe | 200/168 G |
| 3,852,557 | 12/1974 | Brown | 200/241 |
| 3,879,592 | 4/1975 | Comerford et al. | 200/339 |
| 3,935,411 | 1/1976 | Ford | 200/67 G |
| 3,989,915 | 11/1976 | Nishikawa | 200/67 G |
| 4,095,070 | 6/1978 | Simpson | 200/153 J |
| 4,127,754 | 11/1978 | Josemans et al. | 200/275 |

*Primary Examiner*—Willis Little

*Attorney, Agent, or Firm*—Weingarten, Maxham & Schurgin

[57] ABSTRACT

A sub-miniature switch having a pre-shaped wire spring contact movable to one of a plurality of operating positions. The pre-shaped wire spring contact performs the biasing and the detenting functions in addition to the contact function in the switch. Either a toggle, pushbutton or slide may be used for the actuating means of the switch. The wire contact may be pre-formed to provide whichever operating positions are desired. A multiple-pole switch may be constructed using the principles of this invention having a size substantially the same as a similar purpose single-pole switch.

26 Claims, 10 Drawing Figures

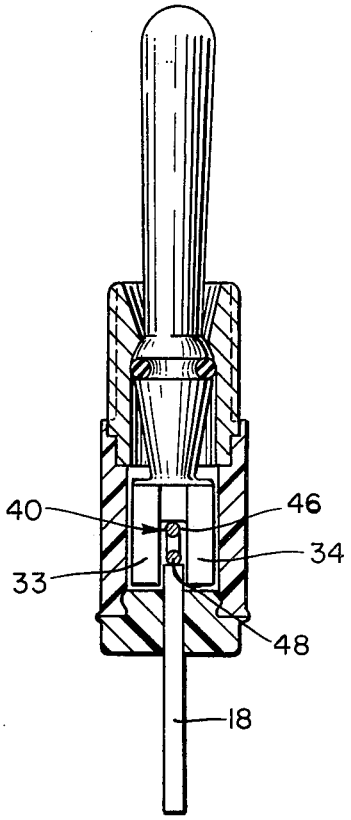
FIG. 6
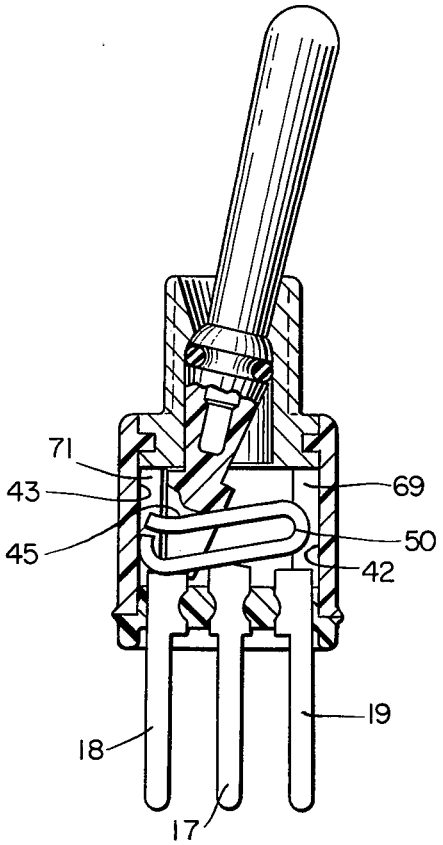
FIG. 3
FIG. 4
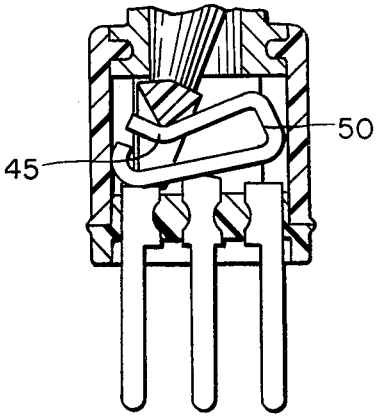
FIG. 5
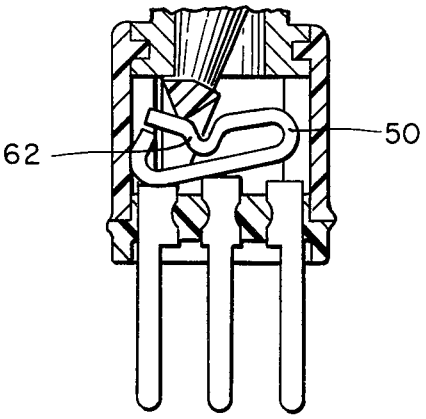

TOGGLE SWITCH WITH SHAPED WIRE SPRING CONTACT

FIELD OF THE INVENTION

This invention relates generally to sub-miniature switches and is more particularly concerned with momentary and alternate action toggle switches of relatively narrow configuration. The principles of the invention may also be applied to pushbutton and slide switches.

DISCUSSION OF THE PRIOR ART

Many types of prior art sub-miniature switches of the alternate action or momentary type are available. The degree of miniaturization of such switches is limited, however, because most of them require separate operating members to perform the functions of making contact, providing a bias to the actuating means, and acting as a detent for the actuating means. Normally, in a toggle switch, and in a pushbutton switch, an internal coil spring is required to bias the switch actuator, such as the toggle or the pushbutton. Furthermore, such switches are subject to periodic failure because of the large number of parts involved. In addition, tolerances become a significant factor in the fabrication of the switches, and may very well prevent the use of standard fabrication techniques, thereby increasing the manufacturing costs of such devices. The large number of parts also contributes to relatively high manufacturing cost.

Several examples of these prior art toggle switches are shown in U.S. Pat. Nos. 3,989,915; 3,935,411; and 3,852,557. Each of the above-referenced toggle switches employs a coiled spring within the toggle lever to provide the necessary biasing pressure, and each employs a non-flexible, conductive blade pivotally mounted within the switch body. Examples of prior art switches using leaf springs are shown in U.S. Pat. Nos. 3,742,171 and 3,670,121, wherein a rocker actuating member mounted onto the housing by laterally disposed pins pivots a leaf spring into a desired operative position by means of an intermediate actuating member. The switches shown therein are of a single throw configuration. A general example of a prior art pushbutton switch is shown in U.S. Pat. No. 4,095,070, assigned to the assignee of the present invention.

SUMMARY OF THE INVENTION

This invention relates to sub-miniature switches which may be actuated either by toggle means, pushbutton means or sliding means, and which may be constructed for use either in an alternate action or a momentary mode. In each instance, a pre-formed wire contact performs the operations of biasing the actuating means, creating an electrical connection between two terminals and acting as a detent to retain the actuating means in the desired operating position.

In the preferred embodiment, the pre-formed wire contact has a generally U-shaped configuration with a lower arm and an upper arm. The lower arm is pivotally disposed on a raised central terminal located between two other electrical terminals. The contact is adapted to be pivoted about the central terminal in response to the action of a switch actuator on the upper arm and to selectively engage the other two terminals. Preferably, the switch actuator is a toggle mechanism having an actuator tip formed of a dielectric material, which rides along the upper arm, an external lever and an enlarged portion captured within the switch by peripheral shoulders formed on the switch housing. The actuator tip is biased away from the terminals and the enlarged portion is biased against the shoulders by the spring action of the contact and, therefore, any additional internal biasing spring of the type found in most prior art toggle switches is not required. Furthermore, by appropriately shaping the contact for the desired switch functions, the contact also satisfies the need for a detent for the actuator tip so that the switch has one or more stable operative positions.

Because of the narrow configuration of the contacts in this switch, a two-pole switch may be constructed merely by placing the wire contacts and the corresponding sets of terminals immediately adjacent one another, and all wire contacts may be operated simultaneously by the same actuator. The size of the switch thus need not be increased to provide a double-pole operation.

In both the slide and pushbutton configurations of this invention, the pre-formed wire contact again serves the three functions of biasing, acting as a detent and providing electrical contact. A pushbutton has a plunger configuration provided with a finger above one of the outer terminals for urging the contact into connection with the terminal and for pivoting the contact about the central terminal. In the slide configuration, the actuator is provided with an actuator tip that rides along the upper arm of the contact to pivot the contact about the central terminal into the desired operative position.

BRIEF DESCRIPTION OF THE DRAWINGS

The objects, advantages and features of this invention will be more clearly appreciated from the following detailed description taken in conjunction with the accompanying drawing in which:

FIG. 3 is a cross-sectional side view of the switch of FIG. 1 configured for ON-ON action;

FIG. 4 is a cross-sectional side view of the switch of FIG. 1 configured for a momentary action;

FIG. 5 is a cross-sectional side view of the switch of FIG. 1 configured for ON-OFF-ON action;

FIG. 6 is a cross-sectional front view of the switch of FIG. 1;

DETAILED DESCRIPTION OF THE PREFERRED EMBODIMENTS

Figure 2:
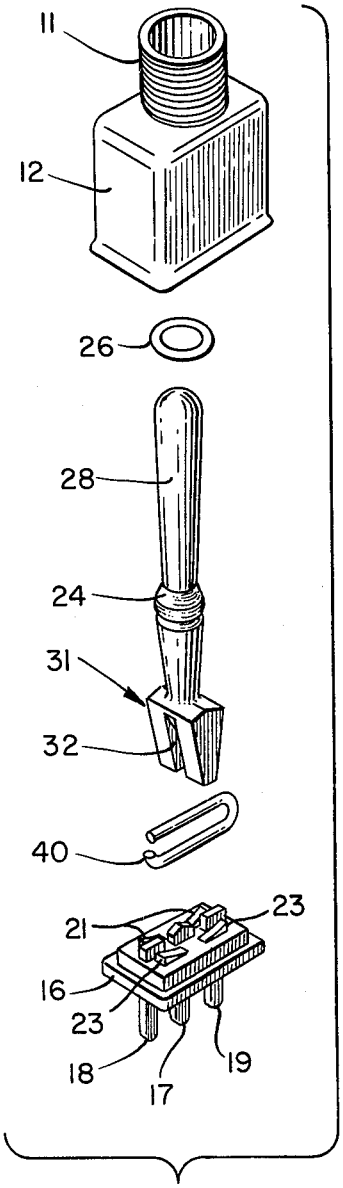
FIG. 2 is an exploded perspective view of the switch of FIG. 1.
Figure 1:
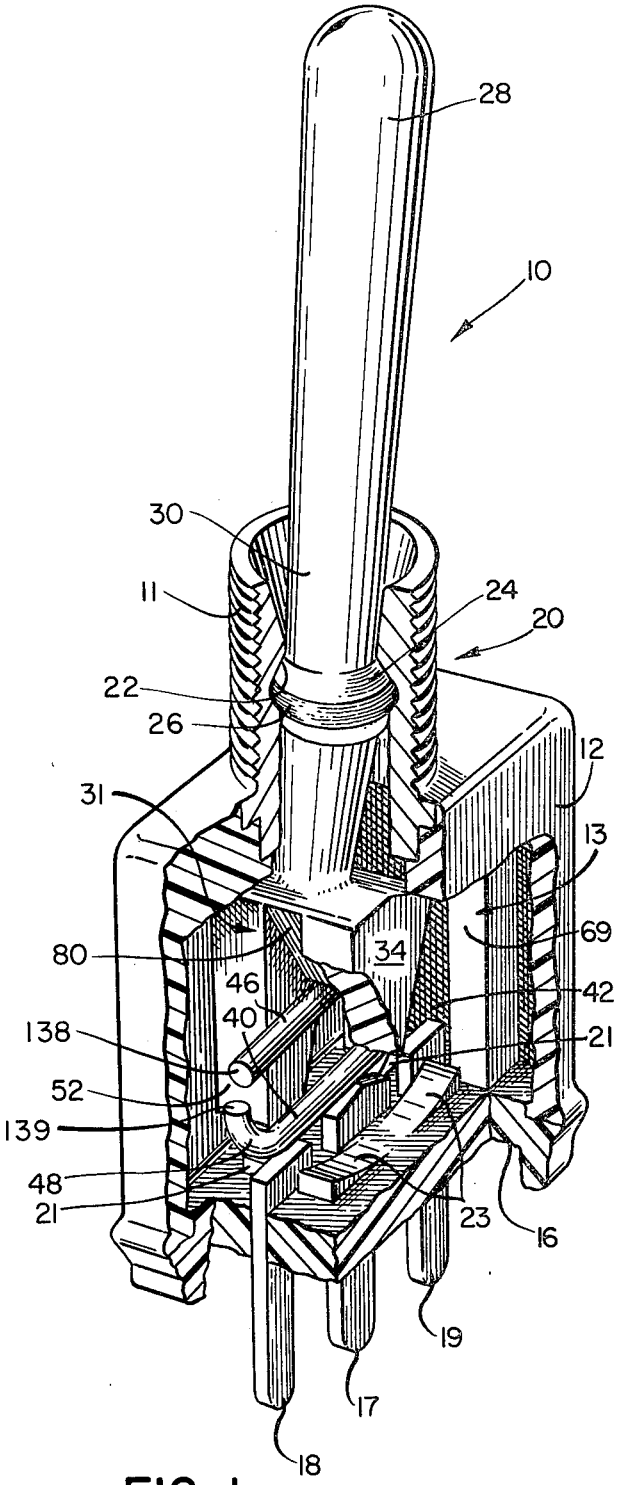
FIG. 1 is a cut-away perspective view of one embodiment of the switch of this invention.

With reference now to the drawing and more particularly to FIGS. 1 and 2 thereof, there is shown a switch 10 comprising an insulative case 12, and insulative base 16 and a normally metal bushing 11. These three elements together comprise the overall static envelope or housing for the switch 10. Extending through bushing 11 is a bore 30, the central portion of which is narrowed to form an annular shoulder 22. Within case 12 is formed a cavity 13 for receiving the operative portions of the switch to be later described.

Extending outwardly from the base 16 of the housing are center electrical terminal 17 and end electrical terminals 18 and 19 preferably spaced symmetrically on either side thereof. Terminals 17, 18 and 19 also project through base 16 into cavity 13 and terminate therein. Center terminal 17 preferably projects a greater distance into cavity 13 than do terminals 18 and 19. The end of terminal 17 within cavity 13 preferably has a raised central portion toward terminals 18 and 19. The ends of terminals 18 and 19 within cavity 13 generally have a flat configuration.

Contact 40 is pivotally disposed on the central portion of raised terminal 17 within cavity 13. Contact 40 is a wire spring which may be pre-shaped into any one of a number of desired configurations and which may be formed of any suitable material having a substantial spring function and long life. Contact 40, as shown, has a substantially U-shaped configuration and includes an upper arm 46, a lower arm 48, a curved resilient bight 50 and a substantially open end 52. Lower arm 48 rests on terminal 17 which serves as a fulcrum for contact 40 to pivot thereabout. Bight 50 of contact 40 is tensioned during shaping and bending so that a bias is imparted to the contact, causing it to have a tendency to pivot upper arm 46 and lower arm 48 away from one another about bight 50 and to thereby enlarge open end 52. Shoulders 69 and 71 formed on side walls of the interior of cavity 13 define grooves 42 and 43 respectively therebetween, as shown in FIGS. 1 and 3. Open end 52 of the contact is laterally confined within groove 43, while bight 50 is laterally confined within groove 42, so that contact 40 is retained in the desired upright position within cavity 13. Grooves 43 and 42 permit end 52 and bight 50 to ride up and down therein as contact 40 pivots about terminal 17.

The actuator assembly 20 extends downwardly through bore 30 and into cavity 13. The actuator 20 includes a toggle lever 28, an enlarged portion 24 and actuator tip 31. Actuator tip 31 includes laterally spaced legs 33 and 34 having a downwardly open channel 32 formed therebetween. Wedge 80, having a downwardly facing apex, is disposed between legs 33 and 34 at the upper termination of channel 32. Legs 33 and 34 are adapted to closely straddle upper arm 46, and the bias applied to contact 40 drives upper arm 46 against the apex of wedge 80 to provide continual tensioned contact therebetween. An upward bias is thereby applied to enlarged portion 24, as shown in FIG. 1, urging portion 24 against shoulder 22 to capture portion 24 within bore 30 and to retain actuator assembly 20 in the desired upright position. This upward bias applied to enlarged portion 24 assists in sealing the switch at bore 30 and in maintaining actuator assembly 20 in a positive condition so that it moves smartly from one operative position to another and stays firmly in a desired operative position. Enlarged portion 24 also is the point about which actuator assembly 20 rotates when lateral force is applied to toggle lever 28. An O-ring seal may be affixed around enlarged portion 24 to provide an oscillatory seal between the enlarged portion 24 and shoulders 22. The combination of the upward bias applied to portion 24 and the presence of O-ring seals 26 would provide an environmentally tight seal between portion 24 and shoulders 22. If desired, the switch may be assembled without an O-ring and its operation is not affected.

Associated with legs 33 and 34 are arcuate ramps 21 and 23, respectively. Ramps 21 and 23 are disposed on base 16 within cavity 13 in confronting relationship with the distal ends of legs 33 and 34, respectively. Ramps 21 and 23 serve as stops so that excessive longitudinal force applied to toggle lever 28 will not urge actuator tip 31 into cavity 13 past a predetermined point. When such longitudinal forces are applied to toggle lever 28, the distal ends of legs 33 and 34 are driven against ramps 21 and 23 when the predetermined point has been reached. This predetermined point depends upon the length of legs 33 and 34 and the displacement of the top of ramps 21 and 23 above the surface of base 16. In this manner, contact 40 is protected from damage or deformation by such forces. Legs 33 and 34 are preferably of sufficient width to provide the strength necessary to withstand any anticipated longitudinal forces.

Lower arm 48 of the contact is pre-shaped to selectively provide an electrical connection between terminal 17 and either terminal 18 or terminal 19, depending on the position of actuator tip 31. Arm 48 is urged into firm electrical connection with the desired terminals by the bias built into contact 40. Upper arm 46 is shaped to serve as a detent for actuator tip 31. The combination of the upper arm 46 configuration and the bias applied to contact 40 maintains actuator tip 31 in a desired operative position. In FIG. 3, for example, a slight upward curve 45 is provided on the left portion of the upper arm 46 to assist in retaining actuator tip 31 in the operative position indicated. The position of actuator tip 31 may be altered by the application of external force to toggle lever 28 which overcomes the detenting effect of arm 46 and the bias applied to contact 40, and which causes actuator 20 to pivot about enlarged portion 24. Actuator tip 31 then rides along arm 46 in continual contact therewith to a new desired operative position. Contact 40 is positioned and shaped so that as actuator tip 31 passes over terminal 17, the distal ends 138 and 139 of arms 46 and 48 are urged tightly together at open end 52. Consequently, upper arm 46 becomes slightly bowed in its center because of the downward force of actuator tip 31 applied at that point. This bowed effect increases the upward bias applied to actuator tip 31 and thus to enlarged portion 24, and it causes actuator tip 31 to snap into the desired operative position from the over-center position. This feature increases the speed of the switching action from one operative position to another and it sharpens the change in operative positions.

The shape of upper arm 46, lower arm 48 and bight 50 also determines the type and number of permitted operative positions. In FIG. 3, for example, the contact 40 is pre-shaped to permit the operative positions of electrical connection between terminals 17 and 18, an ON operative position, and electrical connection between terminals 19 and 17, also an ON operative position. No operative position of OFF is permitted in the configuration of FIG. 3. In FIG. 5, upper arm 46 has been shaped to permit an OFF operative position in which terminal 17 is in electrical connection with no other terminal. Also, terminal 17 has a flattened configuration similar to that of terminals 18 and 19 within cavity 13. Thus, the switch of FIG. 5 is provided with ON (terminals 17 and 18); OFF; and ON (terminals 17 and 19) functions. In FIG. 4, upper arm 46 has been shaped to provide for a momentary function of ON. Thus, when actuator tip 31 is moved to the right along upper arm 46, causing lower arm 48 to create an electrical connection between terminals 17 and 19, tip 31 can only be maintained in that position by the continued application of external pressure to toggle lever 28. Upon the release of external pressure to toggle lever 28, actuator tip 31 will return of its own accord along upper arm 46 to a position to the left end thereof in FIG. 4 and into an ON operative position for connection between terminals 17 and 18.

Operation of the present toggle switch will be understood by reference to FIG. 1 and to FIGS. 3–5 which show various examples of permitted operating modes. In FIG. 3, an electrical connection is made between the central terminal 17 and terminal 18 by means of lower arm 48. It will be noted that the lower arm is in firm contact with terminals 17 and 18 because of the previously described bias imparted to contact 40. In FIG. 3, when external force is applied laterally to the left to toggle lever 28, actuator tip 31 is moved to the right as actuator 20 pivots about its enlarged portion 24 within bore 30. As actuator tip 31 moves to the right in FIG. 3, wedge 80 slides along upper arm 46 which is captured between legs 33 and 34. At the same time, the distal ends 138 and 139 of arms 46 and 48 are urged toward one another at open end 52 until they eventually touch. As actuator tip 31 approaches a position over terminal 17, in its movement to the right, arm 46 becomes progressively more bowed, as actuator tip 31 pushes downwardly on the arm. The combination of curve 45 and this bowing effect cause contact 40 to continue to interconnect terminals 17 and 18 until actuator tip 31 reaches a position to the right of terminal 17 in FIG. 3. Once such a position has been reached, contact 40 pivots rapidly about terminal 17, snapping out of connection with terminal 18 and into connection with terminal 19. Once a connection has been effected between terminals 17 and 19, upper arm 46 snaps back into an unbowed configuration as the distal ends of arms 46 and 48 move apart. When actuator tip 31 reaches the right-hand portion of the cavity 13, upper arm 46 exerts an upward force upon the apex of wedge 80, tending to urge actuator tip 31 further to the right and because of the tilt of assembly 20, actuator tip 31 is retained in that position.

In FIG. 5, a notch 62 is provided in the upper arm 46 of the contact 40, so that as external force is applied to the left to toggle lever 28, and actuator tip 31 is urged to the right in FIG. 5, the apex of wedge 80 settles into notch 62 until further external force is applied to toggle lever 28. When the apex of wedge 80 is settled into notch 62, lower arm 48 is disengaged from terminal 18 and is not yet in connection with terminal 19, thus placing contact 40 in an OFF operative position. Also, the distal ends of arms 46 and 48 are again urged together, thus causing upper arm 46 to be slightly bowed. When additional lateral force is again applied to the left to toggle lever 28, actuator tip 31 moves to the right, pivoting contact 40 into a position in which lower arm 48 is in an ON operative position in which terminal 17 is electrically connected to terminal 19. Actuator tip 31 is biased in that position and is retained there as previously described until lateral force to the right is applied to toggle lever 28. In FIG. 4, upper arm 46 in the vicinity of bight 50 is at a greater distance from lower arm 48 than is upper arm 46 in the vicinity of open end 52. When actuator tip 31 is moved to the right along upper arm 46 under a leftward force applied to toggle lever 28, actuator tip 31 is urged leftwardly again into its original position by the upward slope of upper arm 46, and unless continued external force is applied to the left to toggle lever 28, actuator tip 31 will indeed return of its own accord to the position shown in FIG. 4. Thus, the positioning of actuator tip 31 in the extreme right position of FIG. 4 creates only a momentary ON operative position in which terminal 17 is connected to terminal 19.

Figure 10:
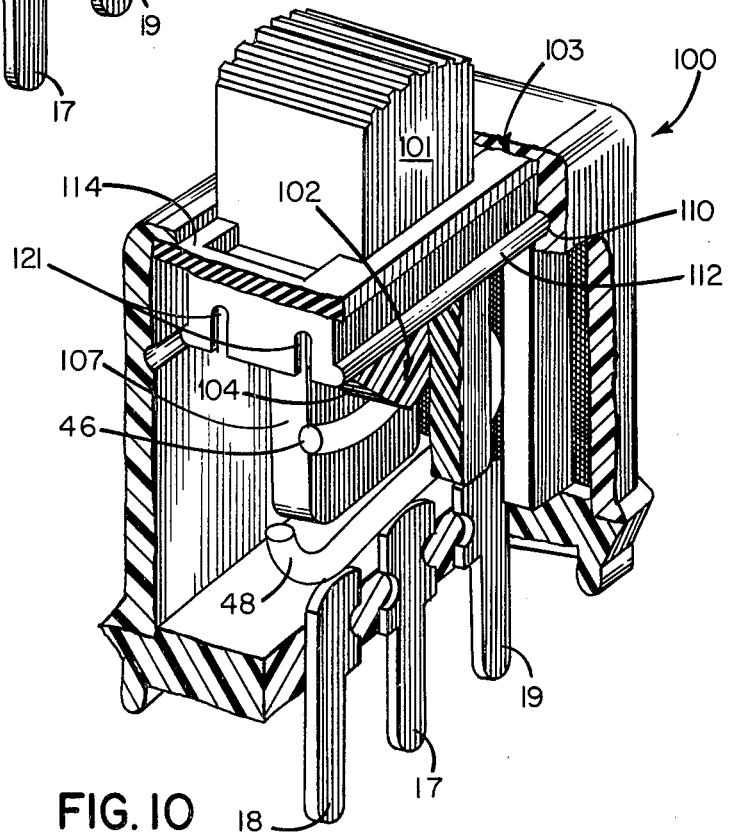
FIG. 10 is a cut-away perspective view of the switch of FIG. 1 showing a slide actuator.

The switch of this invention can be easily modified to be a slide-operated switch as shown in FIG. 10. Like numbers for like parts are used wherever possible. A slide actuator 100 is secured to the top of the case 12 for slidable relation therewith by tongue 112 on actuator 100 and grooves 110 formed in case 12 in a manner known in the art. The slide actuator 100 has an upper lever portion 101 and a lower actuator tip 102 composed of a dielectric material. Actuator tip 102 includes substantially parallel legs 107 and 108 extending downwardly from lever portion 101 through slot 103 and into cavity 13. A channel 104 containing wedge 106 is formed between legs 107 and 108. An apex of wedge 106 rides along the upper arm 46 of contact 40 as slide actuator 100 is moved from one operative position to another. Slide actuator 100 is slidable from left to right and right to left in FIG. 10 along grooves 110 which are engaged by tongue 112 of slide actuator 100. Flexible seal 114, sandwiched between surface 115 of slide actuator 100 and the underside of the case 12 within cavity 13, seals cavity 13 from the external environment. Cutouts 119 on either side of slide actuator 100 accommodate seal 114. Cutouts 121, two of which are provided on each longitudinal end of slide actuator 100, allow actuator 100 to be laterally flexible so that tongue 112 may be snapped into grooves 110 and so that the spring bias provided by cutouts 121 retains tongue 112 securely within groove 110. Contact 40 is provided with a bias as described for the embodiment of FIG. 1 which urges slide actuator 100 in a direction away from terminals 17, 18 and 19, such that tongue 112 remains in sliding engagement with grooves 110. As in the embodiment of FIG. 1, the upper arm 46 of contact 40 serves as a detent and the combination of the bias applied to upper arm 46, the location and the shape of wedge 106 and the shape of upper arm 46 will act to retain actuator 100 in a desired operative position. Also, the shape of contact 40 determines which operative positions are available. The switch shown in FIG. 10 is provided with an ON (terminals 17 and 18)-ON (terminals 17 and 19) function. The provision of a notch in upper arm 46 would permit an ON-OFF-ON function.

When it is desired to change the operative position of the switch from the ON operative position shown in FIG. 10, lateral external pressure is applied to lever portion 101 urging it to the right. In response thereto, actuator tip 102 similarly slides to the right, and wedge 106 rides along upper arm 46 of contact 40. As actuator tip 102 moves to the right, contact 40 pivots about terminals 17, thereby disconnecting lower arm 48 from terminal 18 and connecting lower arm 48 with terminal 19 as actuator tip 102 moves to a position to the right of terminal 17 in FIG. 10. Lower arm 48 now is in electrical contact with terminals 17 and 19. When it is desired to return the switch to the original operative mode, shown in FIG. 10, lateral leftward external pressure is again applied to lever 101, urging actuator tip 102 to the left. As actuator 100 moves to the left, actuator tip 102 again rides along upper arm 46, thereby causing contact 40 to pivot about terminal 17 and causing lower arm 48 to disconnect from terminal 19 and connect with terminal 18.

Figure 8:
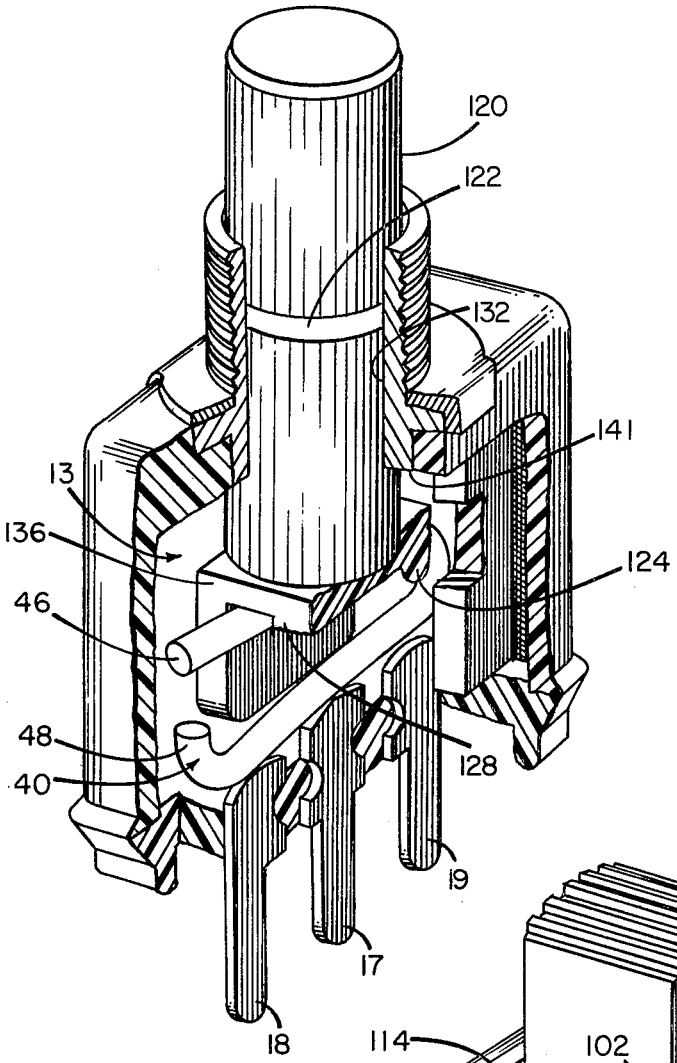
FIG. 8 is a cut-away perspective view of the switch of FIG. 1 showing a pushbutton actuator.
Figure 9:
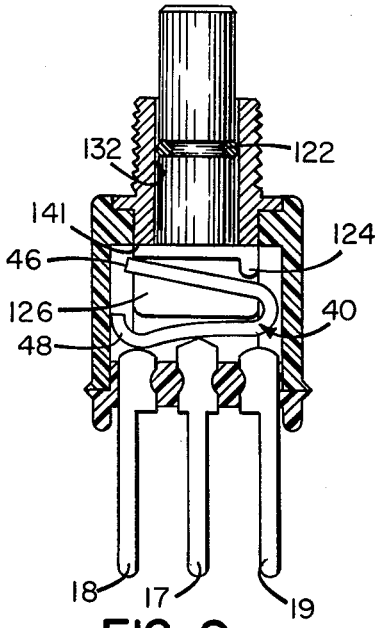
FIG. 9 is a cross-sectional side view of the switch of FIG. 8.

The switch shown in FIG. 1 can also be easily modified to be a momentary action pushbutton switch, as shown in FIGS. 8 and 9. Like numerals are used for like parts wherever possible. Plunger 120 extends through bore 132 in bushing 11 and into cavity 13. The lower portion of plunger 120 includes a dielectric actuator tip 136 which has legs 126 and 128 extending downwardly into cavity 13 and a groove 130 formed therebetween. Upper arm 46 of the contact is disposed within groove 130, straddled by legs 126 and 128. Within groove 130 is actuator finger 124 disposed generally above terminal 19. O-ring seals 122 may be used to slidingly seal plunger 120 with the inner surface of bore 132 to environmentally seal chamber 13, but seal 122 is not essential to the functioning of the switch. Lower arm 48 is pre-formed so that it assumes a slightly bowed configuration symmetrically disposed about terminal 17 whereby open end 52 and bight 50 of lower arm 48 dip toward terminals 18 and 19, respectively. Upper arm 46 of contact 40 is directed at an angle away from lower arm 48 such that the distal end 138 of upper arm 46 is in constant contact with a portion 123 of actuator tip 136 within groove 130. The bias applied to contact 40 serves to urge plunger 120 in an upward direction and to provide the necessary spring action thereto. In addition, the bias also insures that lower arm 48 makes firm electrical contact with terminals 17 and 18 or 19.

Plunger 120 is restricted in its upward movement by upper surface 141 of actuator tip 136 which extends beyond the edges of bore 132 within cavity 13. Thus, as pressure is removed from plunger 120, surface 141 is driven against upper surfaces of cavity 13 by contact 40 which prevents further upward movement. Contact 40 is protected from damage or deformation from excessive downward longitudinal forces by legs 126 and 128 which limit the permissible downward incursion of plunger 120 into cavity 13 to a predetermined distance.

The operative position shown in FIGS. 8 and 9 is that of an ON position in which terminals 17 and 18 are interconnected. If the operative position is desired to be changed, downwardly directed external pressure is applied to plunger 120, and thus to actuator tip 136, which drives finger 124 into engagement with upper arm 46 in close proximity to bight 50. Contact 40 is thereby pivoted about terminal 17 such that lower arm 48 moves into connection with terminal 19 adjacent bight 50 and disconnects from terminal 18 near open end 52. When external pressure is released from plunger 120, the spring bias imparted to contact 40 causes upper arm 46 to move away from lower arm 48 and return plunger 120 to its original position, as shown in FIG. 9. Thus, finger 124 no longer exerts a downward pressure on arm 46 near bight 50. Contact 40 then pivots of its own accord about terminal 17 toward the left under the influence of the previously described bias, causing lower arm 48 to disconnect from terminal 19 and to connect with terminal 18.

Figure 7:
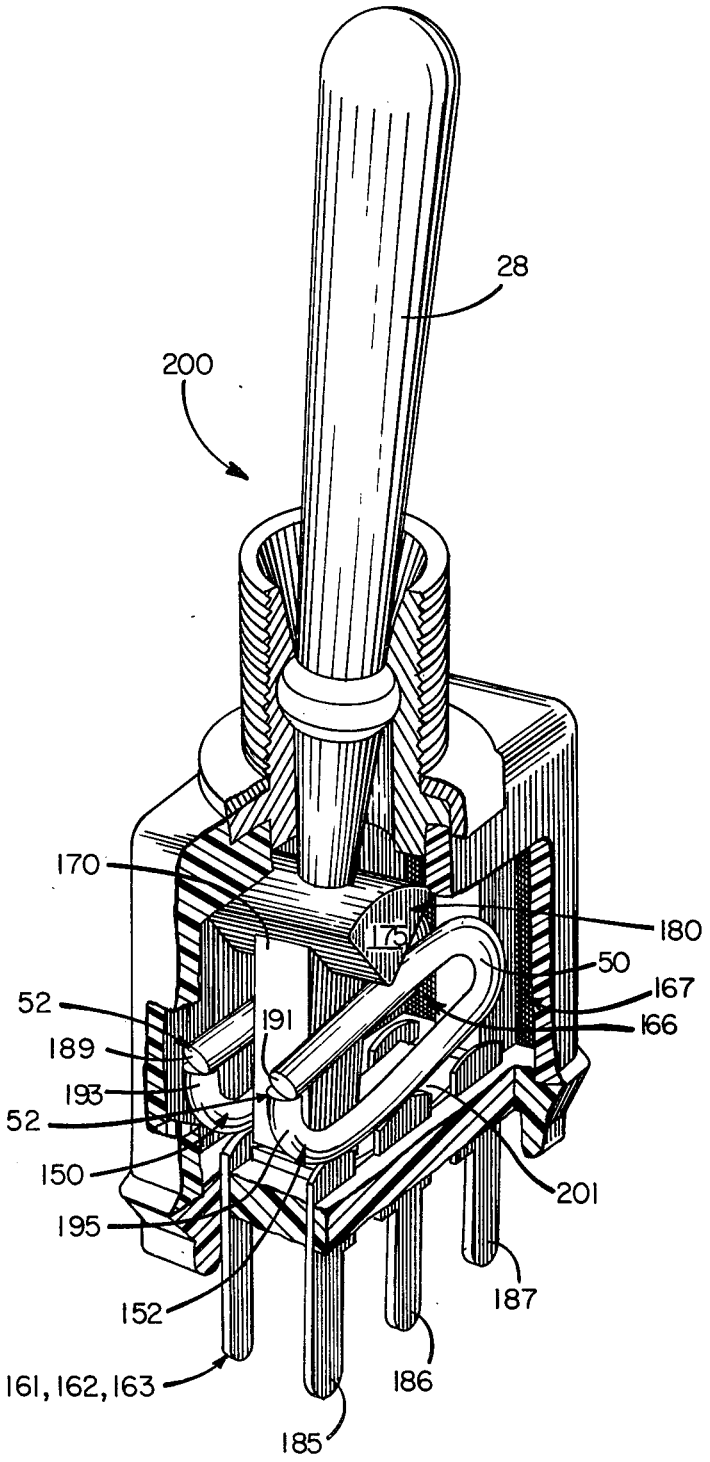
FIG. 7 is a cut-away perspective view of the switch of FIG. 1 showing the modifications necessary for use of the switch as a double-pole device.

As seen in FIG. 7, the concept of this invention can easily be extended to a multiple-pole switch. A double-pole configuration does not require that the switching case or housing be wider than that found in the single-pole switch of FIG. 1. A double-pole switch 200 has two sets of terminals 161-163 and 185-187, and their associated pre-shaped wire contacts, 150 and 152, respectively. Contacts 150 and 152 can be formed in any of the shapes shown for contacts 40 in FIGS. 1 through 5. Contacts 150 and 152 are disposed adjacent the walls of case 12 and are laterally restrained and retained in an upright position by respective grooves 166 and 167 disposed adjacent their bights 50 and open ends 52. Actuator tip 180 has a wedge 175 and a single leg 170 extending therefrom. Leg 170 serves to maintain a separation between contacts 150 and 151 and to retain these contacts in their desired positions. Leg 170 has a width similar to that shown in FIG. 1. Leg 170 has an associated arcuate ramp 201 similar to ramps 21, 23 of FIG. 1. Portions of an apex of wedge 175 ride along upper arms 189 and 191, thereby causing contacts 150 and 152 to pivot about central terminals 162 and 186, respectively, on lower arms 193 and 195, as previously described for the embodiment of FIG. 1. In all other respects, this configuration is identical to and operates in substantially the same manner as that previously described for the single-pole, double-throw switch shown in FIG. 1.

Some of the components of this switch may be formed in several different configurations for specialized purposes, but their shape, in general, forms no part of this invention. Furthermore, the switch itself may be mounted in a panel by known means and it is not necessary that these means be discussed in detail herein. The case 12 is typically composed of a non-conductive material such as thermoplastic or thermoset plastic material. The bushing 11 may be formed of a metallic material such as plated brass which is insert-molded or otherwise attached to case 12. Bushing 11 may also be plastic and form an integral part of the molded case 12. The actuator tip 31 is composed of a dielectric material, preferably a heat-resistant plastic, while the lever 28 may be metallic or the lever 28 and actuator tip 31 may be a single piece of plastic molding. The contact 40 may be formed from any conductive resilient material, such as plated beryllium copper.

For reference purposes, examples of the dimensions of a single-pole switch of this invention are set forth. It is to be understood that by providing such examples, the scope of the invention is in no way limited. The casing and housing form a combination typically of 0.30 inch (7.62 mm) high 0.30 inch (7.62 mm) wide, and 0.20 inch (5.08 mm) thick. The terminals typically project 0.25 inch (6.35 mm) outwardly from the case and the bushing and toggle lever extend 0.567 inch (14.4 mm) above the housing.

In view of the above description, it is likely that modifications and improvements will occur to those skilled in the art which are within the scope of this invention.

What is claimed is:

1. An electrical switch comprising:

a housing defining a chamber therein and having an orifice formed on a first side thereof;

a plurality of spaced electrical terminals mounted on a second side of said housing opposite of said first side, each one of said terminals having a first portion extending into said chamber a predetermined distance, and a second portion projecting outwardly from said housing;

a switch actuator extending through said orifice and into said chamber and confronting said plurality of terminals, said actuator having a portion external to said chamber and adapted to receive force to move said actuator, a middle portion residing within said orifice in oscillatory, unsecured contact with surfaces of said housing disposed on the perimeter of said orifice, and an actuator tip within said chamber movable in response to force applied to said external portion; and a wire spring contact disposed in engagement with said actuator tip within said chamber and adapted to be pivoted by movement of said actuator into one of an available plurality of discrete, preselected operating positions in which said contact is selectively electrically connected to at least one of said plurality of terminals when said contact is in at least one of said operating positions, said contact providing a spring bias operative alone to urge said middle portion of said actuator into contact with said orifice, and having a predetermined shape operative alone to determine said available plurality of preselected operating positions, said shape and said bias alone being operative to selectively retain said actuator tip in one of said preselected operating positions.

2. The switch recited in claim 1 wherein said contact is in a first operating position when it interconnects said first portions of some of said terminals, and wherein said contact is in a second operating position when it interconnects said first portions of others of said terminals.

3. The switch recited in claim 2 wherein said plurality of terminals comprises:

at least one center terminal, about said first portion of which said contact means is adapted to pivot; and at least one end terminal spaced from said center terminal and adapted to be selectively interconnected to said center terminal by said contact when said contact is pivoted into one of said operating positions.

4. The switch recited in claim 3 wherein said first portion of said center terminal extends farther into said chamber than said first portion of said end terminal.

5. The switch recited in claim 1 wherein said plurality of terminals comprises two end terminals symmetrically disposed about a center terminal and wherein said contact has an upper arm in communication with said actuator tip and a lower arm pivotable about said center terminal in response to force applied to said upper arm by said actuator tip, said lower arm being adapted to electrically interconnect said center terminal with at least one of two of said end terminals.

6. The switch recited in claim 5 wherein said contact is formed from a unitary length of electrically-conductive extruded wire and further comprises a resilient bight joining said upper arm to said lower arm.

7. The switch recited in claim 6 wherein said bias is operative to urge said upper arm to pivot about said bight in a direction away from said lower arm and towards said actuator tip.

8. The switch recited in claim 7 wherein said bias is operative to urge said lower arm into electrical contact with at least one of said plurality of terminals.

9. The switch recited in claim 1 or 6 wherein said switch actuator comprises a toggle lever pivotable about said middle portion into a plurality of operating positions.

10. The switch recited in claim 6 wherein said switch actuator comprises a toggle lever pivotable about said middle portion and wherein said middle portion of said toggle lever is enlarged with respect to said external portion.

11. The switch recited in claim 10 wherein said upper arm of said contact has a slot in a position directly above said center terminal for receiving said actuator tip to provide an operating position in which said contact is in electrical connection only with said center terminal.

12. The switch recited in claim 10 wherein said upper arm of said contact is generally parallel to said lower arm to provide two operating positions, one operating position interconnecting the center terminal with an end terminal disposed to one side, and a second operating position interconnecting said center terminal with another end terminal disposed on a side of said center terminal opposite to said one side.

13. The switch recited in claim 10 wherein said upper arm is spaced farther from said lower arm at one end thereof than at another end thereof to provide a momentary operating position with respect to an interconnection between said center terminal and one of said end terminals adjacent said one end thereof, said momentary operating position being operable only when continuous pressure is applied to said external portion.

14. The switch recited in claim 1 or 5 wherein said switch actuator comprises a plunger adapted to be actuated by the application of force to said external portion in a downwardly direction towards said chamber.

15. The switch recited in claim 7 wherein said switch actuator comprises a plunger extending through said orifice in said housing and into said chamber, said switch actuator having a finger formed on said actuator tip and extending therefrom into said chamber directly over one of said end terminals, said finger being adapted for pivoting said contact about said center terminal into interconnection with one of said end terminals in one of said operating positions when said plunger is depressed into said chamber, and wherein said bias is operative to urge said plunger in a direction away from said plurality of electrical terminals and to urge said contact into another of said operating positions when said plunger is not depressed into said chamber in which said contact interconnects said central terminal with another of said end terminals.

16. The switch recited in claim 15 wherein said plunger is provided with an O-shaped seal affixed to the outer surface of said middle portion, said seal being in slidable sealing engagement with the inner surface of said orifice.

17. The switch recited in claim 1 or 5 wherein said switch actuator comprises a slide-operated means adapted to be actuated by the transverse application of force in a direction substantially perpendicularly of said switch actuator.

18. The switch recited in claim 7 wherein said switch is slidably mounted to said housing, whereby when said switch member is slid to a first operating position, opposite one of said end terminals, said contact provides a connection between said end terminal and said central terminal, and when said switch member is slid to a second operating position opposite another of said end terminals, said contact provides a connection between said central terminal and said other terminal.

19. The switch recited in any one of claims 1, 7, 10 or 18 further comprising:

a second plurality of spaced electrical terminals mounted on said second side adjacent said plurality of terminals, each terminal of said second plurality of terminals having a first portion extending into said chamber a predetermined distance and a second portion projecting outwardly from said housing;

a second wire spring contact disposed in engagement with said actuator tip adjacent said contact within said chamber and adapted to be pivoted by movement of said actuator tip simultaneously with said contact into one of said available plurality of discrete, preselected operating positions in which said second contact is selectively electrically connected to at least one of said second plurality of terminals when said contact is in at least one of said operating positions, said second contact having a spring bias and the same predetermined shape as said contact, said second contact shape and said second contact bias in combination with said contact shape and said contact bias being operative alone to selectively retain said actuator tip in one of said preselected operating positions, said predetermined shape of said contact and said second contact being operative alone to determine said available plurality of preselected operating positions, and said contact bias and said second contact bias being operative alone to urge said middle portion of said actuator into contact with surfaces of said housing disposed on the perimeter of said orifice.

20. The switch recited in claim 19 further comprising:

a leg extending from said actuator tip toward said terminal and being disposed between said second contact and said contact;

an arcuate ramp confronting the distal end of said leg and being disposed on said housing between said plurality of terminals and said second plurality of terminals.

21. The switch recited in any one of claims 1, 7, 10 or 18 further comprising a pair of spaced legs extending from said actuator tip toward said terminal and being disposed on either side of said contact.

22. The switch recited in claim 21 further comprising a pair of spaced arcuate ramps disposed within said chamber on said second side of said housing on either side of said plurality of terminals, each of said ramps being disposed in a normally spaced confronting relationship with a distal end of one of said legs.

23. The switch recited in claim 7 or 10 wherein said actuator tip is operative to urge together said upper arm and said lower arm and to bow said upper arm downwardly adjacent the center thereof when said actuator tip is disposed generally above said center terminal.

24. The switch recited in claim 23 wherein said contact is adapted to pivot rapidly of its own accord from one operative position to another operative position when said actuator tip is positioned at a location on said upper arm at a predetermined distance from a point directly opposite said center terminal, and wherein said contact is adapted to assist in moving said actuator tip along said upper arm from said location on said upper arm at said predetermined distance from said point to another position on said upper arm when said actuator tip is positioned at said location at a predetermined distance from said point.

25. An electrical switch comprising:

a housing defining a chamber therein and having an orifice formed on a first side thereof;

three spaced electrical terminals mounted on a second side of said housing opposite of said first side, each one of said terminals having a first portion extending into said chamber a predetermined distance, and a second portion projecting outwardly from said housing, said three terminals comprising a center terminal and two end terminals symmetrically disposed about said center terminal, said first portion of said center terminal extending into said chamber a greater distance than said first portion of said two end terminals;

a toggle switch actuator extending through said orifice and into said chamber and confronting said terminals, said actuator having a toggle portion external to said chamber and adapted to receive lateral force to pivot said actuator, a middle portion in oscillatory engagement with said orifice about which said actuator is adapted to pivot, and an actuator tip within said chamber movable in response to lateral force applied to said toggle portion;

a wire spring contact in said chamber having an upper arm, a lower arm, a curved resilient bight connecting said upper arm and said lower arm, and an open end wherein a distal end of said upper arm is spaced from a distal end of said lower arm, said upper arm being disposed in sliding engagement with said actuator tip and said lower arm being pivotally disposed on said center terminal in electrial connection therewith, said contact being adapted to be pivoted by said actuator tip into a plurality of discrete, preselected operating positions in which said contact is selectively electrically connected to at least one of said plurality of terminals when said contact is in at least one of said operating positions, said contact having a spring bias provided by the bending of said contact about said bight which is operative to urge said middle portion of said actuator into engagement with said orifice, said contact having a predetermined shape, said shape and said bias being operative to selectively retain said actuator tip in one of said preselected operative positions;

a pair of spaced legs extending downwardly from said actuator tip toward said second side, said legs having said contact disposed therebetween;

a pair of spaced arcuate ramps mounted on said second side, and having said electrical terminals disposed therebetween, each one of said ramps being disposed in a spaced, confronting relationship with a distal end of a corresponding one of said legs and being adapted to restrict the penetration of said legs and said actuator tip into said chamber to a predetermined distance;

a first pair of shoulders disposed on a first end of said housing substantially perpendicular of said second side and defining a groove therebetween adapted to accept said bight and to restrict lateral movement of said contact in a desired upright position in which said upper arms is in sliding engagement with said actuator tip; and a second pair of shoulders disposed on a second end of said housing opposite of and facing said first end and defining a groove therebetween adapted to accept said open end and to restrict lateral movement of said contact and maintain said contact in said desired upright position.

26. An electrical switch, comprising:

a housing defining a chamber therein and having an orifice formed on a first side thereof;

a plurality of spaced electrical terminals mounted on a second side of said housing opposite of said first side, each one of said terminals having a first portion extending into said chamber a predetermined distance and a second portion projecting outwardly from said housing, said plurality of terminals comprising a first terminal centrally disposed within said chamber and at least one end terminal, said first portion of said first terminal extending into said chamber a greater distance than said first portion of said one end terminal;

a switch actuator extending through said orifice and into said chamber and confronting said plurality of terminals, said actuator having a portion external to said chamber and adapted to receive a lateral force to move said actuator, a middle portion disposed within said orifice in oscillatory, unattached contact therewith, and an actuator tip within said chamber movable in response to lateral force applied to said external portion of said actuator;

a wire spring contact in said chamber having an upper arm, a lower arm and a curved resilient bight interconnecting said upper arm and said lower arm, said upper arm being disposed in sliding engagement with said actuator tip and said lower arm being pivotally disposed on said first terminal in electrical connection therewith, said contact being adapted to be pivoted by said actuator tip into a plurality of discrete, preselected operating positions in which said contact is selectively electrically connected to at least one of said plurality of terminals when said contact is in at least one of said operating positions, said contact having a spring bias provided by the bending of said contact about said bight which is operative alone to urge said middle portion of said actuator into contact with said orifice, said contact having a predetermined shape, said shape and said bias being operative alone to selectively retain said actuator tip in one of said preselected operating positions;

at least one leg extending downwardly from said actuator tip toward said second side, said leg being disposed closely adjacent said contact but spaced therefrom;

an arcuate ramp mounted on said second side and being disposed in a spaced, confronting relationship with a distal end of said leg, said ramp being adapted to restrict the penetration of said leg and said actuator tip into said chamber to a predetermined distance; and a pair of shoulders disposed on an end of said housing substantially perpendicularly of said second side and defining a groove therebetween adapted to accept one end of said upper arm and one end of said lower arm of said contact and to restrict a lateral movement of said contact in a desired upright position in which said upper arm is in sliding engagement with said actuator tip.

* * * * *